United States Patent [19]

Raker et al.

[11] Patent Number: 4,924,887

[45] Date of Patent: May 15, 1990

[54] TOBACCO RODS AND FILTERS

[75] Inventors: Mark L. Raker; Andrew J. Sensabaugh, Jr.; Stephen W. Jakob, all of Winston-Salem, N.C.

[73] Assignee: R. J. Reynolds Tobacco Company, Winston-Salem, N.C.

[21] Appl. No.: 825,704

[22] Filed: Feb. 3, 1986

[51] Int. Cl.[5] ..... A24B 3/14; A24D 3/02

[52] U.S. Cl. ..... 131/331; 131/370; 131/375; 131/353; 131/343; 493/39; 493/41; 493/43; 493/49

[58] Field of Search ..... 131/331, 344, 340–343, 131/370, 375, 353; 493/39, 41, 43, 49

[56] References Cited

U.S. PATENT DOCUMENTS

| | | | |
|---|---|---|---|
| 232,873 | 10/1880 | Baron . | |
| 235,885 | 12/1880 | Lindsley . | |
| 2,152,416 | 3/1939 | Molins . | |
| 2,158,928 | 5/1939 | Deich . | |
| 2,190,107 | 2/1940 | Pohle . | |
| 2,792,006 | 5/1957 | Marek . | |
| 2,804,874 | 9/1957 | Visnick . | |
| 2,948,282 | 8/1960 | White . | |
| 3,046,994 | 7/1962 | Schur . | |
| 3,101,723 | 8/1963 | Seligman et al. . | |
| 3,219,041 | 11/1965 | Bromberg . | |
| 3,313,305 | 4/1967 | Noznick et al. . | |
| 3,353,543 | 11/1967 | Sproull et al. . | |
| 3,361,139 | 1/1968 | Inoue . | |
| 3,368,566 | 2/1968 | Avedikian . | |
| 3,428,050 | 2/1969 | Kandel . | |
| 3,516,417 | 6/1970 | Moses . | |
| 4,391,285 | 7/1983 | Burnett | 131/364 |
| 4,391,285 | 7/1983 | Burnett et al. . | |
| 4,510,950 | 4/1985 | Keritsis et al. | 131/375 |
| 4,516,589 | 5/1985 | Rainer et al. . | |

FOREIGN PATENT DOCUMENTS

| | | |
|---|---|---|
| 466296 | 9/1928 | Fed. Rep. of Germany . |
| 781960 | 8/1957 | United Kingdom . |
| 871102 | 6/1961 | United Kingdom . |
| 940059 | 10/1963 | United Kingdom . |
| 1013303 | 12/1965 | United Kingdom . |
| 1174076 | 12/1969 | United Kingdom . |

*Primary Examiner*—V. Millin

[57] ABSTRACT

Tobacco containing cigarette filter plugs comprise strands of tobacco material which are bound with an activated binding agent. The filter plugs exhibit good firmness and integrity, and provide cigarettes exhibiting a unique tobacco taste. Filter plugs are prepared by forming an intimate admixture of tobacco material and binding agent, forming rods and activating the binding agent.

40 Claims, 1 Drawing Sheet

TOBACCO RODS AND FILTERS

BACKGROUND OF THE INVENTION

This invention relates to smoking articles, and in particular to smoking articles having rods containing tobacco material.

Popular smoking articles such as cigarettes comprise a substantially rod shaped structure and include a charge of smokable material such as tobacco surrounded by a wrapper such as paper. It has become desirable to provide cigarettes having filters constructed from fibrous materials such as cellulose acetate. Such filters can provide unique taste characteristics to cigarettes as well as preventing tobacco particles from being drawn into the smoker's mouth during use of the cigarette.

It would be highly desirable to provide a smoking article such as a cigarette which exhibits the desirable characteristics of a filter cigarette while providing the user with a unique tobacco taste.

SUMMARY OF THE INVENTION

This invention is a process for providing a tobacco containing rod suitable for the preparation of cigarette filter plugs, the process comprising the steps of:

(a) providing particles of tobacco material, and
(b) providing a binding agent, and
(c) contacting the particles of tobacco material and the binding agent, and then
(d) providing an intimate admixture of the tobacco material and the binding agent, and then
(e) forming a rod shaped article from the intimate admixture, and then
(f) subjecting the binding agent to activation conditions.

In another aspect, this invention is a process for providing a tobacco containing filter plug, the process comprising the steps of:

(a) providing particles of tobacco material, and
(b) providing a binding agent, and
(c) contacting the particles of tobacco material and the binding agent, and then
(d) providing an intimate admixture of the tobacco material and the binding agent, and then
(e) forming a rod shaped article from the intimate admixture, and then
(f) providing filter elements from the rod, and then
(g) subjecting the binding agent to activation conditions.

In another aspect, this invention is a process for providing a tobacco containing rod suitable for the preparation of cigarette filter plugs, the process comprising the steps of:

(a) providing particles of tobacco material, and
(b) providing a binding agent, and
(c) contacting the particles of tobacco material and the binding agent, and then
(d) providing an intimate admixture of the tobacco material and the binding agent, and then
(e) subjecting the binding agent to activation conditions, and then
(f) forming a rod shaped article from the intimate admixture, and then
(g) subjecting the rod shaped article to conditions sufficient to provide further firmness thereto.

In another aspect, this invention is a process for providing a tobacco containing rod suitable for the preparation of cigarette filter plugs, the process comprising the steps of:

(a) providing an intimate admixture of particles of tobacco material and binding agent, and then
(b) contacting the intimate admixture with a further amount of particles of tobacco material in order to provide a further intimate admixture of tobacco material and binding agent, and then
(c) forming a rod shaped article from the further intimate admixture, and then
(d) subjecting the binding agent to activation conditions.

In another aspect, this invention is a process for providing a tobacco containing filter plug, the process comprising the steps of:

(a) providing an intimate admixture of particles of tobacco material and binding agent, and then
(b) contacting the intimate admixture with a further amount of particles of tobacco material in order to provide a further intimate admixture of tobacco material and binding agent, and then
(c) forming a rod shaped article from the further intimate admixture, and then
(d) providing filter elements from the rod; and then
(e) subjecting the binding agent to activation conditions.

In yet another aspect, this invention is a tobacco containing cigarette filter plug comprising a filter element and a circumscribing wrap. The wrap circumscribes the longitudinally extending surface of the filter element. The ends of the filter plug are open in order to permit the passage of air and smoke therethrough. The filter element comprises particles of tobacco material (e.g., strands of tobacco material) in intimate contact with binding agent which has been subjected to activation conditions so as to provide a filter element which is characterized as having a firmness value of less than 10 units as measured for a cylindrical rod shaped element having a circumscribing wrap, the rod shaped element having a length of about 100 mm and a circumference of about 24.5 mm, the measurement being performed at 76° F. and 60 percent relative humidity using a Cigarette Firmness Tester Model No. CFTA supplied by Fairchild Industries, Winston-Salem, North Carolina, U.S.A. The firmness value is measured by applying force to the filter element transversely to the longitudinal axis of the filter element.

In still another aspect, this invention is a cigarette comprising a rod of smokable material axially aligned with the aforementioned tobacco containing filter plug.

The process of this invention allows for the efficient and effective preparation of tobacco containing rods and in particular tobacco containing filters for use in the manufacture of cigarettes. Of particular interest is the fact that tobacco containing filters of this invention when incorporated into cigarettes are capable of providing the user thereof with a unique tobacco taste. Also of interest is the fact that the firmness of the tobacco containing filters is such that the filter exhibits good integrity whereby problems associated with tobacco particles being drawn into the user's mouth are minimized or eliminated under conditions of normal use. As a consequence, the tobacco containing filters provide a suitable mouth-piece for cigarettes.

DETAILED DESCRIPTION OF THE EMBODIMENTS

The filter plug of this invention and cigarettes containing the filter plug of this invention will be described with reference to FIGS. 1, 2 and 3 in which like elements are given like reference throughout.

Figure 1:
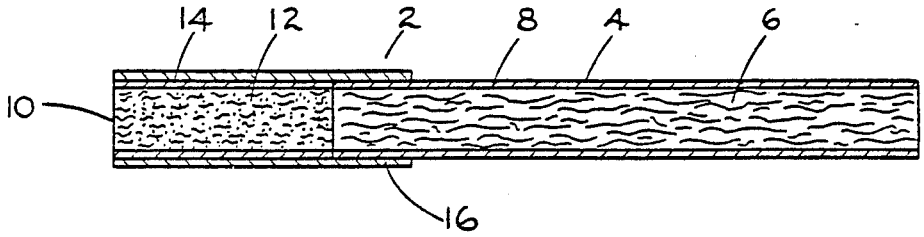
FIG. 1 is a diagrammatic cross sectional illustration of a cigarette showing the rod of smokable material and the tobacco containing filter element.

An embodiment of this invention shown in FIG. 1 is a smoking article 2 in the form of a cigarette. The cigarette comprises a generally cylindrical rod 4 of smokable material 6 contained in a wrapping material 8. Typically, the smokable material is a charge of cured or processed tobacco, reconstituted tobacco, tobacco substitute, or blend thereof. The smokable material generally is provided as conventionally employed in the manufacture of cigarettes (i.e., as strands of material provided at about 32 cuts per inch and treated with conventional additives such as flavorants). Typically, the wrapping material is a conventional cigarette wrapping paper. The ends of the rod are open to expose the smokable material. Rod 4 has a diameter comparable to that of conventional cigarettes and generally ranges from about 7 mm to about 8 mm. Rod 4 has a longitudinally extending length comparable to the tobacco rod length of conventional cigarettes and generally ranges from about 55 mm to about 85 mm. The smoking article further comprises filter plug 10 positioned adjacent to one end of rod 4 such that the filter plug is axially aligned with the rod in an end-to-end relation. Filter plug 10 has a substantially cylindrical shape, and the diameter of the rod is substantially equal to the diameter of the filter plug. Preferably, the filter plug substantially abuts the rod. The ends of the filter plug are open to permit the passage of air and smoke. The filter plug comprises a tobacco containing filter element 12 which is overwrapped (i.e., enveloped) along the longitudinally extending surface thereof with a circumscribing wrap material 14 such as a conventional paper cigarette wrap, filter plug wrap, or the like. The wrap material can be a substantially air impermeable material or an air permeable material, including conventional plug wrap or other types of paper wrap. The filter plug has a longitudinally extending length comparable to the filter plug length of a conventional cigarette, and generally ranges from about 20 mm to about 35 mm. Filter plug 10 is attached to rod 4 by tipping material 16 which circumscribes both the filter plug and an adjacent region of the rod. The inner surface of the tipping material is fixedly secured to the outer surface of the filter plug and to the wrapping material of an adjacent region of the rod. The tipping material circumscribes the rod over a longitudinal length which can vary but is typically that length sufficient to provide good attachment of the filter plug to the rod. Typically, the tipping material is either a conventional air permeable tipping material or a conventional substantially air impermeable tipping material such as tipping paper. If desired, openings such as slits, holes, or perforations in the substantially air impermeable tipping material and the plug wrap can provide a means for air dilution of the smoking article.

Figure 2:
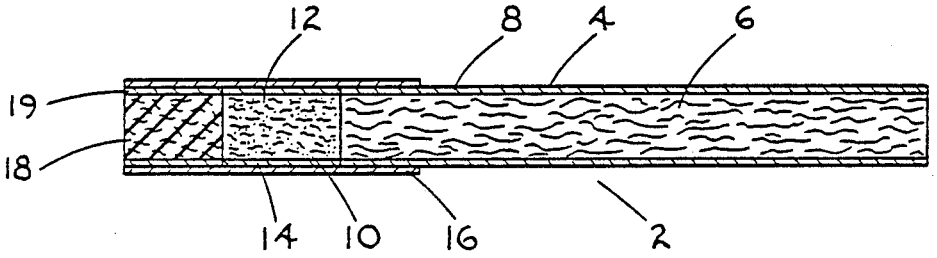
FIG. 2 is a diagrammatic cross sectional illustration of a cigarette showing the rod of smokable material, the tobacco containing filter element, and the second filter element.

An embodiment of this invention shown in FIG. 2 is a smoking article in the form of a cigarette comprising a generally cylindrical rod 4 of smokable material 6 contained in wrapping material 8. The smoking article further comprises a filter region including tobacco containing filter element 12 which is overwrapped with a cirumscribing wrap material 14. The overwrapped tobacco containing filter element is axially aligned with the rod in an end-to-end relation, has a substantially cylindrical shape, has a diameter which is substantially equal to that of the rod, and preferably substantially abuts the rod. The filter region further includes a second filter element 18 which is axially aligned with the tobacco containing filter element. Optionally, the second filter element is overwrapped with a circumscribing wrap material 19 such as a conventional filter plug wrap, or the like. Second filter element 18 is axially aligned with tobacco containing filter element 12 in an end-to-end relation, has a substantially cylindrical shape, has a diameter in combination with the optional wrap material which is substantial equal to that of the rod, and preferably substantially abuts the tobacco containing filter element. Second filter element 18 can be conventional tow material such as cellulose acetate, polypropylene, or the like. Second filter element 18 can have a generally fibrous character, a molded shape, or other such configuration. The longitudinal length of second filter element 18 relative to the longitudinal length of tobacco containing filter element 14 can vary depending upon the application desired. The filter region (i.e., aligned tobacco containing filter element 12 and second filter element 18) is attached to rod 4 by tipping material 16 which circumscribes both the filter region and an adjacent region of the rod.

Figure 3:
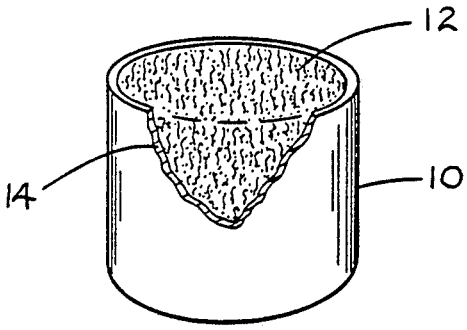
FIG. 3 is a perspective of an enlarged tobacco containing filter plug showing the filter element and the partially cut away wrap.

In FIG. 3 is shown filter plug 10 including tobacco containing filter element 12 and circumscribing wrap material (which is shown as partially cut away). The filter plug has a substantially cylindrical shape.

The tobacco containing rod is provided from tobacco material in the form of particles of tobacco material. As used herein the term "particles" is meant to include pieces of tobacco material each having a size suitable for providing filter elements according to this invention. For example, it is desirable that the particles be of a size small enough to ultimately provide a filter element having acceptable filtration ability and efficiency; while it is desirable that the particles be of a size large enough to ultimately provide a filter element having acceptable integrity and firmness. If desired, at least a portion of the strands of tobacco material can be subjected to volume expansion. The tobacco containing rod and resulting filter element most preferably are provided from tobacco material in the form of strands. By the term "strand" is meant tobacco material having a thickness substantially equal to cured or processed tobacco leaf and a length substantially greater than the thickness and width thereof. Typical widths of strands range from less than about 30 cuts per inch to greater than about 100 cuts per inch, preferably from less than about 45 cuts per inch to greater than about 60 cuts per inch. Typical lengths of strands range from about 0.25 inch to about 3 inches. Typical tobacco material includes cured tobacco leaf, reconstituted tobacco material, processed tobacco such as expanded tobacco, and the like. For purposes of this invention, strands of tobacco material are meant to not include particles of leaf stem or other stem materials; however if desired, particles of tobacco leaf stems or other stems can be employed in combination with the aforementioned strands of tobacco material.

The tobacco material which is employed in providing tobacco containing rods and resulting filter elements preferably is contacted with moisture in the form of water in order to process the tobacco material according to this invention. Typically the moisture content depends upon factors such as the particular binding agent which is employed. By the term "moisture content" is meant the percent weight loss of tobacco material after heating said material at 220° F. for 5 minutes. Typically, the moisture content of the tobacco material during processing prior to activation of the binding agent ranges from about 10 percent to about 20 percent. It is particularly desirable to provide tobacco material having a moisture content above about 10 percent in order to provide particles of tobacco material which are not overly brittle for processing. It is particularly desirable to provide tobacco material having a moisture content sufficiently low in order that there does not occur substantial transfer of moisture from tobacco material to binder prior to that time that activation of binding agent occurs. In certain instances the particular tobacco material can have a sufficient moisture content without the necessity of additional moisture. It is most desirable to provide the desired moisture content to the tobacco material either prior to or after (i.e., rather than during) the time that the tobacco material is contacted with the binding agent. For example, when dextrin is employed as a binding agent it is most desirable to contact the binding agent with tobacco material having a moisture content in the range from greater than about 10 percent to less than about 16 percent, preferably from about 12 percent to about 13 percent.

Binding agents useful in this invention include guar gum, xanthan gum, carboxymethylcellulose, dextrin, maltodextrin, heat seal resins such as Piccotac No. 4724-02 which is commercially available from Hercules, Inc., and the like, as well as combinations thereof. It is particularly desirable to employ a binding agent which can coat the surface of the particles of tobacco material and which ultimately is capable of adhering the particles of tobacco material.

The amount of binding agent employed can vary depending upon factors such as the type of binder, the binding properties of the binder, the coating ability of the binder, the size of the individual particulates of binder, the size of the strands of tobacco material, the desired density of the tobacco filters, the amount of moisture present, the temperature at which the tobacco material is processed, the time over which the tobacco material is processed, and other such factors. Typically, the amount of binding agent ranges from about 5 percent to about 20 percent, preferably about 8 percent to about 12 percent, based on the total weight of the tobacco material, moisture and binding agent.

It is desirable to employ the binding agent in a substantially dry form. By the term "substantially dry form" is meant that the binding agent is employed in a particulate form and most preferably in a non-binding form. For example, the binding agent can be employed in powder form, crystalline form, as dust, or the like. Preferably, the diameters of the individual particles of binding agent are less than about 10 microns. It is believed that the use of binding agent in particulate form provides a convenient means for providing an intimate admixture of binding agent and tobacco material. For example, fine, high surface area particulates of binding agent can efficiently coat or cover the surface of the tobacco material.

The tobacco material (which optionally has been subjected to volume expansion) and binding agent are contacted, and the resulting moist admixture is subjected to conditions sufficient to provide an intimate admixture thereof. It is most desirable that the intimate admixture be tobacco material which is coated as thoroughly as possible with binding agent in essentially the non-binding form. Most preferably, the intimate admixture exhibits properties such that the admixture can be further processed in a conventional tobacco rod-making apparatus. Most preferably, the intimate admixture is a pliable, substantially free-flowing mixture of tobacco material. Typical processes for providing the intimate admixture of tobacco material and binding agent can involve contacting, mixing and drying using rotary tumbling drum, fluidized bed apparatus, enclosed vibrating conveyor belt, or the like. If desired, the intimate admixture can be further processed (e.g., essentially unexpanded tobacco material can be subjected to volume expansion using techniques such as are taught in U.S. Pat. No. 3,524,451, which is incorporated herein by reference). Typically, tumbling and air suspension processing provide the most useful types of mixing action. It is preferable to dry (e.g., heated air drying) the resulting intimate admixture to the extent necessary to provide a pliable, substantially free-flowing mixture of tobacco material. In particular, it is most desirable that the intimate admixture not be so tacky or sticky in character as to not be processable using a conventional cigarette rod making machine; and that the intimate admixture approaches resembling conventional cut filler.

In one aspect of this invention, tobacco material (which optionally has been subjected to volume expansion) is contacted with binding agent and moisture. If desired, the binding agent can be provided in the form of a solution (e.g., as an aqueous solution) and can be contacted with the tobacco material using techniques such as spraying, or the like. The tobacco material and binding agent are mixed or blended using techniques such as tumble blending, or the like. It is preferable to subject the tobacco material and binding agent to mixing or blending action during the spraying thereof with solution of binding action. The mixing is continued until an intimate admixture of tobacco material and binding agent are formed (e.g., a tacky mixture, a clumped mixture, etc., is provided). The intimate admixture can be further processed if desired (e.g., essentially unexpanded tobacco material of the intimate admixture can be subjected to conditions sufficient to provide volume expansion thereof). To the intimate admixture is then added a further amount of tobacco material (which optionally has been subjected to volume expansion). The resulting mixture is further mixed or blended until further intimate admixture of tobacco material and binding agent is provided.

The intimate admixture of tobacco material and binding agent is formed into a rod shape. Typically, the rod is provided using conventional apparatus and processes for making tobacco rods. For example, the tobacco material can be formed into rods of the desired size using machines such including Molins 686, Hauni Protos, Molins Mark IX, and the like. The operation of such machines and the methods for providing tobacco containing rods using such machines are readily apparent to the skilled artisan. The resulting rods are generally cylindrical and comprise a charge of the tobacco material, which is intimately admixed with binding agent, contained in a tubular wrapping material such as cigarette paper, plug wrap, or the like. Typical rod sizes range in length from about 80 mm to about 120 mm, and from about 22 mm to about 25 mm in circumference.

The resulting rods are suitably employed in the manufacture of cigarette filters. In one aspect, the rods are subjected to conditions such that the binding agent which is intimately admixed with the tobacco material within the rod is activated. By the term "activation" is meant that the binding agent changes from an essentially non-binding coating of the tobacco material to a material exhibiting binding properties. That is, the latent adhesive properties of the binding agent are developed during activation. Activation conditions include the application of heat, moisture and/or pressure to the rod. Such conditions can be provided by radiation (e.g., infrared or microwave) high humidity chamber, steam conditions such as can be applied on the cigarette rod making machine, or other such means. For example, when dextrin is employed as a binding agent it is most preferable to subject the tobacco material to a moisture content of greater than 16 percent during activation. The resulting rod can be cut to the desired size and employed as filter elements for cigarettes. In another aspect, the rods can be employed in the manufacture of filter elements for cigarettes prior to activation of the binding agent, and the resulting cigarettes can be subjected to conditions such as aging which allow for activation of the binding agent. In another aspect, the intimate admixture of tobacco material and binding agent is subjected to activation conditions and then a rod shaped article is formed from the resulting mixture. The resulting rod can be used in the manufacture of filter elements if desired. The resulting rod or filter elements are then subjected to conditions sufficient to provide further firmness thereto. Such conditions include for example, aging under warm conditions, dry conditions, and the like.

During use the moisture content of the filter element can vary. For example, when dextrin is employed as a binding agent the moisture content of the tobacco material preferably ranges from greater than about 10 percent to less than about 16 percent, more preferably from about 12 to about 13 percent.

Typical filter elements which are provided according to this invention exhibit good firmness and good integrity. The filter elements of this invention exhibit a firmness value of less than 10 units characteristic of a cylindrical rod shaped element having a circumscribing wrap (e.g., cigarette paper), which rod has a lenght of about 100 mm and circumference of about 24.5 mm as measured at 76° F. and 60 percent relative humidity using a Cigarette Firmness Tester Model No. CFTA supplied by Fairchild Industries, Winston-Salem, North Carolina. As used herein, the term "units" in referring to the firmness value represents each 0.1 mm of vertically measured depression exhibited by the filter element when subjected to a force in the form of a load supplied transversely to the longitudinal axis thereof (i.e., the direction of the force supplied by the load is perpendicular to the longitudinal axis of the filter element). The depression exhibited by the filter element is determined by subjecting a 1 inch diameter, flattened stainless steel testing pad equipped with a load (total weight thereof is about 20 g) which rests on the filter element to the force provided by a 205 g load which is placed on the testing pad for a period of 5 seconds. A low measured firmness value represent a high firmness of the sample. Preferably, the firmness value of the filter elements is less than about 5, more preferably between about 3 and about 5, for elements evaluated as described hereinbefore.

It is understood that the particular embodiments described herein are only illustrative of the principles of this invention, and that various modifications can be made by those skilled in the art without departing from the scope and spirit of this invention. For example, ovoidal shaped filter rods, filter elements and cigarettes can be manufactured. In addition, cylindrical or tubular tobacco containing flavor delivery elements can be manufactured.

The following examples are provided in order to further illustrate the invention but should not be construed as limiting the scope thereof. Unless otherwise noted, all parts and percentages are by weight.

EXAMPLE 1

Cured tobacco leaf is cut at 52 cuts per inch using a conventional tobacco leaf cutting apparatus in order to provide strands of cut tobacco having lengths which predominately range from about 0.25 inch to about 3 inches. The strands exhibit a moisture content of 13 percent, based on the total weight of tobacco and moisture. The strands are placed in a rotary tumbling drum and are contacted with enough binder to provide a resulting mixture having 10 percent binder, based on the total weight of the resulting mixture. The binder is dextrin and is sold commercially as American Maize #1706 Dextrin. The moisture content of the resulting mixture is raised to 16 percent by adding water thereto. The resulting mixture was processed by mixing in the tumbling drum at 17 rpm at 76° F. for 5 minutes. The resulting processed tobacco material is a relatively sticky, tacky agglomeration of strands as compared to conventional cut filler. The processed tobacco material is stored in a sealed plastic bag for further use.

Substantially cylindrical tobacco filter rods are provided by feeding the processed tobacco material into a conventional cigarette rod making machine commercially available as a 686 Maker by Molins wherein the wrapping for the resulting rod is a commercially available substantially air impermeable cigarette paper wrap. The resulting wrapped rods have 24.53 mm circumference and are cut into 100 mm lengths. The wrapped rods are placed in a conventional filter tray and subjected to 76° F. and 60 percent relative humidity for about 1 day to about 3 days in order to provide cured rods wherein the processed tobacco material exhibits a moisture content of about 13.5 percent. The resulting cured wrapped rods exhibit a pressure drop of about 300 mm of water as determined using an encapsulated pressure drop tester sold commercially as Model No. FTS-300 by Filtrona Corporation. The cured rods have 24.38 mm circumference, exhibit a weight of 2.11 g/rod, and exhibit a firmness value of 3.59 mm as measured using a Cigarette Firmness Tester Model No. CFTA supplied by Fairchild Industries (i.e., the tested filter element is subject to further a depression of 0.359 mm when subjected to a further load of 205 g).

The wrapped rods are transferred from the filter tray to a Molins Mark IX cigarette making machine. The wrapped rods are each cut into 25 mm length filter cylindrical filter plugs. Each filter plug is attached to one end of a conventionally prepared tobacco rod (i.e., a charge of cut filler wrapped in cigarette wrapping paper) having a length of 59 mm and circumference approximately equal to that of the filter plug, using non-porous cigarette tipping paper. The tipping paper circumscribes the filter plug along the length of the filter plug and along about 7 mm the tobacco rod which abuts one end of the filter plug. The tipping paper is secured to the filter plug and tobacco rod by applying adhesive to the inner portion of the tipping paper.

The resulting cigarette is provided with an air dilution means by providing perforations in the tipping paper and plug wrap using an on-line laser air dilution perforation method. Each cigarette exhibits air dilution of 25 percent wet total particulate matter (minus nicotine and water) of 17.6 mg.

EXAMPLE 2

Cured tobacco leaf is cut at 52 cuts per inch using a conventional tobacco leaf cutting apparatus in order to provide strands of cut tobacco having lengths which predominately range from about 0.25 inch to about 3 inches. The strands exhibit a moisture content of 11 percent. The strands are placed in a rotary tumbling drum and are contacted with enough binder to provide a resulting mixture having 10 percent binder, based on the total weight of the resulting mixture. The binder is dextrin and is sold commercially as American Maize #1706 Dextrin. The resulting mixture was processed by mixing in the tumbling drum at 17 rpm at 76° F. for 5 minutes. The resulting processed tobacco material is in the form of strands similar in character to cut filler.

Substantially cylindrical tobacco filter rods are provided by feeding the processed tobacco material into a conventional cigarette rod making machine commercially available as a 686 Marker by Molins wherein the wrapping for the resulting rod is a commercially available substantially air impermeable cigarette paper wrap. The resulting wrapped rods have 24.53 mm circumference and are cut into 100 mm lengths. The wrapped rods are placed in a conventional filter tray and subjected to 98 percent relative humidity at 90° F. for about 2 hours until the moisture content of the tobacco material is about 20 percent. The tobacco material is over dried until the moisture content thereof is about 12.5 percent. The tobacco material is again subjected to 98 percent relative humidity at 90° F. for about 2 hours, and the material is then over dried as previously described.

The wrapped rods are transferred from the filter tray to a Molins Mark IX cigarette making machine. The wrapped rods are each cut into 25 mm length filter cylindrical filter plugs. Each filter plug is attached to one end of a conventionally prepared tobacco rod (i.e., a charge of cut filler wrapped in cigarette wrapping paper) having a length of 59 mm and circumference approximately equal to that of the filter plug, using non-porous cigarette tipping paper. The tipping paper circumscribes the filter plug along the length of the filter plug and along about 7 mm of the tobacco rod which abuts one end of the filter plug. The tipping paper is secured to the filter plug and tobacco rod by applying adhesive to the inner portion of the tipping paper.

The resulting cigarette is provided with an air dilution means by providing perforations in the tipping paper and plug wrap using an on-line laser air dilution perforation method. Each cigarette exhibits air dilution of 40 percent.

EXAMPLE 3

Flue cured tobacco leaf is cut at 32 cuts per inch using a conventional tobacco leaf cutting apparatus in order to provide strands of cut tobacco having lengths which predominately range from about 0.25 inch to about 3 inches. The strands exhibit a moisture content of about 13 percent, based on the total weight of tobacco and moisture. The strands are placed in a rotary tumbling drum and are sprayed during tumbling with an aqueous solution containing binder using an air nozzle. The aqueous solution contains 30 percent dextrin (sold commercially as American Maize #1706 Dextrin) and 70 percent water. The tumbling and spraying continues for about 10 minutes until the amount of binder in contact with the tobacco is about 10 percent, based on the combined weight of binder and pre-treated tobacco material. The resulting mixture is a sticky, tacky, clumped agglomeration of tobacco and binder having a moisture content of 26 percent, based on the total weight of the mixture. The tobacco material of the mixture is expanded using a batch expansion process and a fluorocarbon generally as described in U.S. Pat. No. 3,524,451. The resulting tobacco material/binding agent mixture is recovered in a substantially free flowing form and has undergone about 100 percent volume expansion.

In a tumbling drum is placed flue cured tobacco leaf cut at 32 cuts as described hereinbefore. The tobacco strands are tumbled in the presence of moisture until the moisture content thereof is about 20 percent. To these strands of tobacco is added an equal weight of the expanded tobacco/binder mixture described hereinbefore. The mixture is subjected to mixing in the tumbling drum for about 10 minutes at about 76° F.

The resulting mixture is formed into substantially cylindrical rods by feeding the mixture into a conventional cigarette rod making machine commercially available as a 686 Maker by Hauni, and wherein the wrapping of the resulting rod is a commercially available substantially air impermeable cigarette paper wrap. Rods can be made in this manner for an essentially indefinite period without substantial buildup of binder on the metal parts of the rod making machine.

The wrapped rods are cured to a solid form by storage for about 6 hours to about 12 hours at 76° F. and 60 percent relative humidity. Alternatively, the wrapped rods are cured to a solid form by placing the rods in a filter tray, subjecting the rods to conditions of 98° F. and 90 percent relative humidity for about 1 hour, and allowing the rods to set at 76° F. and 60 percent relative humidity for about 1 to about 2 hours.

The resulting rods can be employed in manufacturing filter elements and filter cigarettes, as described hereinbefore.

What is claimed is:

1. A process for providing a tobacco containing rod suitable for the preparation of cigarette filter plugs, the process comprising the steps of:

(a) providing particles of tobacco material, and (b) providing a binding agent, and (c) contacting the particles of tobacco material and the binding agent with one another, and then (d) providing an intimate admixture of the tobacco material and the binding agent, the admixture having a moisture content of less than 16 percent, and then (e) forming a rod shaped article having a circumscribing outer wrap from the intimate admixture using a tobacco rod-making apparatus, and then (f) subjecting the binding agent to activation conditions.

2. The process of claim 1 wherein said particles of tobacco material are strands of tobacco material.

3. The process of claim 2 wherein said strands have widths which range from less than about 45 cuts per inch to greater than about 60 cuts per inch.

4. The process of claim 1 wherein said binding agent is dextrin.

5. A process for providing a tobacco containing filter plug, the process comprising the steps of:

(a) providing particles of tobacco material, and (b) providing a binding agent, and (c) contacting the particles of tobacco material and the binding agent with one another, and then (d) providing and intimate admixture of the tobacco material and the binding agent, the admixture having a moisture content of less than about 16 percent, and then (e) forming a rod shaped article having a circumscribing outer wrap from the intimate admixture using a tobacco rod-making apparatus, and then (f) providing filter elements from the rod, and then (g) subjecting the binding agent to activation conditions.

6. The process of claim 5 wherein said particles of tobacco material are strands of tobacco material.

7. The process of claim 6 wherein said strands have widths which range from less than about 45 cuts per inch to greater than about 60 cuts per inch, is dextrin.

8. The process of claim 5 wherein said binding agent is dextrin.

9. The process of claim 5 wherein the filter plug so provided is cylindrical in shape.

10. A process for providing a tobacco containing rod suitable for the preparation of cigarette filter plugs, the process comprising the steps of:

(a) providing particles of tobacco material, and (b) providing a binding agent, and (c) contacting the particles of tobacco material and the binding agent with one another, and then (d) providing an intimate admixture of the tobacco material and the binding agent, the admixture having a moisture content of less than about 16 percent, and then (e) subjecting the binding agent to activation conditions, and then (f) forming a rod shaped article having a circumscribing outer wrap from the intimate admixture using a tobacco rod-making apparatus, and then (g) subjecting the rod shaped article to conditions sufficient to provide further firmness thereto.

11. The process of claim 10 wherein said particles of tobacco material are strands of tobacco material.

12. The process of claim 10 wherein said strands have widths which range from less than about 45 cuts per inch to greater than about 60 cuts per inch.

13. The process of claim 10 wherein said binding agent is dextrin.

14. A tobacco containing cigarette filter plug comprising a filter element and a circumscribing wrap, said wrap circumscribing the longitudinally extending surface of the filter element such that the ends of the filter plug are open in order to permit the passage of air and smoke therethrough, wherein said filter element comprises strands of tobacco material in intimate contact with binding agent which has been subjected to activation conditions so as to provide a filter element which is characterized as having a firmness value of less than 10 units as measured for a cylindrical rod shaped element having a circumscribing wrap, said rod shaped element having a length of about 100 mm and a circumference of about 24.5 mm, the measurement being performed at 76° F. and 60 percent relative humidity using a Cigarette Firmness Tester Model No. CFTA supplied by Fairchild Industries.

15. The filter plug of claim 14 characterized as having a firmness value of less than about 5.

16. The filter plug of claim 15 wherein said wrap is cigarette paper wrap or paper plug wrap.

17. The filter plug of claim 14 wherein the binding agent is dextrin.

18. A cigarette comprising a rod of smokable material axially aligned with the tobacco containing filter plug of claim 14.

19. The filter plug of claim 18 wherein particles of tobacco stem material is combined with the aforementioned strands.

20. A cigarette of claim 18 wherein the tobacco containing filter plug is further aligned with a second filter element.

21. The filter plug of claim 14 wherein said plug has a substantially cylindrical shape.

22. The filter plug of claim 14 wherein at least a portion of the strands of tobacco material have been subjected to volume expansion.

23. The filter plug of claim 14 wherein said wrap is cigarette paper wrap or paper plug wrap.

24. A cigarette comprising a rod of smokable material axially aligned with the tobacco containing filter plug of claim 23.

25. A cigarette of claim 24 wherein the tobacco containing filter plug is further aligned with a second filter element.

26. The filter plug of claim 14 wherein particles of tobacco stem material is combined with the aforementioned strands.

27. A process for providing a tobacco containing rod suitable for the preparation of cigarette filter plugs, the process comprising the steps of:

(a) providing an intimate admixture of particles of tobacco material and binding agent, and then (b) contacting the intimate admixture with a further amount of particles of tobacco material in order to provide a further intimate admixture of tobacco material and binding agent, the admixture having a moisture content of less than about 16 percent, and then (c) forming a rod shaped article having a circumscribing outer wrap from the further intimate admixture using a tobacco rod-making apparatus, and then (d) subjecting the binding agent to activation conditions.

28. The process of claim 27 wherein at least a portion of the tobacco material which is provided has been subjected to volume expansion conditions.

29. The process of claim 27 wherein the intimate admixture of tobacco material and binding agent is subjected to conditions sufficient to provide volume expansion of the tobacco material.

30. The process of claim 27. wherein said binding agent is dextrin.

31. The process of claim 27 wherein said particles of tobacco material are strands of tobacco material.

32. The process of claim 27 wherein the intimate admixture of particles of tobacco material and binding agent is provided by spraying an aqueous solution of binding agent onto said tobacco material while subjecting the tobacco material and binding agent to mixing or blending action.

33. The process of claim 32 wherein said intimate admixture is subjected to conditions sufficient to provide volume expansion of the tobacco material.

34. The process of claim 27 wherein the intimate admixture of particles of tobacco material and binding agent is provided by spraying an aqueous solution of binding agent onto said tobacco material while subjecting the tobacco material and binding agent to mixing or blending action.

35. The process of claim 34 wherein said intimate admixture is subjected to conditions sufficient to provide volume expansion of the tobacco material.

36. A process for providing a tobacco containing filter plug, the process comprising the steps of:

(a) providing an intimate admixture of particles of tobacco material and binding agent, and then (b) contacting the intimate admixture with a further amount of particles of tobacco material in order to provide a further intimate admixture of tobacco material and binding agent, the admixture having a moisture content of less than about 16 percent, and then (c) forming a rod shaped article having a circumscribing outer wrap from the further intimate admixture using a tobacco rod-making apparatus, and then (d) providing filter elements from the rod; and then (e) subjecting the binding agent to activation conditions.

37. The process of claim 36 wherein at least a portion of the tobacco material which is provided has been subjected to volume expansion conditions.

38. The process of claim 36 wherein the intimate admixture of tobacco material and binding agent is subjected to conditions sufficient to provide volume expansion of the tobacco material.

39. The process of claim 36 wherein said binding agent is dextrin.

40. The process of claim 36 wherein said particles of tobacco material are strands of tobacco material.

* * * * *

UNITED STATES PATENT AND TRADEMARK OFFICE

CERTIFICATE OF CORRECTION

PATENT NO. : 4,924,887

DATED : May 15, 1990

INVENTOR(S) : Raker et al.

It is certified that error appears in the above—identified patent and that said Letters Patent is hereby corrected as shown below:

Column 7, line 55, "lenght" should be —length—.

Column 9, line 38, "Marker" should be —Maker—.

In the Claims:

Column 11, line 35, after "inch" please delete —, is dextrin—.

Signed and Sealed this

Sixteenth Day of July, 1991

*Attest:*

*Attesting Officer*

HARRY F. MANBECK, JR.

*Commissioner of Patents and Trademarks*